US005174761A

United States Patent [19]

Kodaira

[11] Patent Number: 5,174,761

[45] Date of Patent: Dec. 29, 1992

[54] ELECTRICAL CONNECTOR

[75] Inventor: Kazuaki Kodaira, Kawasaki, Japan

[73] Assignee: AMP Incorporated, Harrisburg, Pa.

[21] Appl. No.: 892,592

[22] Filed: May 26, 1992

Related U.S. Application Data

[63] Continuation of Ser. No. 579,918, Sep. 7, 1990, abandoned.

[30] Foreign Application Priority Data

Jan. 30, 1989 [JP] Japan ..... 1-20400

[51] Int. Cl.[5] ..... H01R 39/02

[52] U.S. Cl. ..... 439/31; 439/11

[58] Field of Search ..... 439/1, 11-13, 439/31

[56] References Cited

U.S. PATENT DOCUMENTS 4,632,475 12/1986 Tomita ..... 439/31 X
4,657,320 4/1987 Bamford et al. ..... 439/31
4,715,819 12/1987 Iwasa et al. ..... 439/31
4,877,409 10/1989 Tanigawa et al. ..... 439/31

*Primary Examiner*—Eugene F. Desmond
*Attorney, Agent, or Firm*—Adrian J. LaRue; John R. Hopkins

[57] ABSTRACT

An electrical connector comprises a first housing (11) having electrical contacts (18) secured therein and a second housing (12) pivotally mounted within the first housing (11) with electrical contacts (27) secured in the second housing (12) in electrical engagement with respective contacts (18) so that the housings (11, 12) can be angularly positioned with respect to one another when circuit boards to which they are electrically connected are positioned at an angle relative to each other.

5 Claims, 4 Drawing Sheets

ELECTRICAL CONNECTOR

This application is a continuation of application Ser. No. 07/579,918 filed Sep. 7, 1990, now abandoned.

This invention relates to an electrical connector, more specifically to an electrical connector having a pair of housings to secure contacts therein. One of the housings is angularly adjustable with respect to the other housing. It is particularly suitable for a telephone.

An example of a conventional telephone is shown in FIG. 6. The telephone includes a base housing 3 and a cover housing 4 to be mated with the base housing 3. One printed circuit board 2 is mounted in parallel with a horizontal bottom surface of the base housing 3 while the other printed circuit board 1 is mounted in parallel with a sloped top surface of the cover housing 4. Both printed circuit boards 1, 2 are interconnected by way of wire harness. In detail, a male connector 5 is connected to the printed circuit board 2 by soldering. A connector 7 at one end of the wire harness 6 is soldered to the other printed circuit board 1. A female receptacle-type connector 8 at the other end is removably connected to a male type connector 5.

In the above telephone, the connector 8 is first connected to the connector 5 and then the cover housing 4 is mated with the base housing 3, thereby requiring at least two connection steps. Such steps, especially the mating the connectors 5, 8 is difficult and time consuming especially because of the generally minimum length of the wire harness 6.

It is therefore a primary object of this invention to provide an electrical connector free from the aforementioned problem by making electrical connection between a pair of connectors already mounted on the printed circuit boards simultaneously with mounting of the cover housing on the base housing.

It is another object of this invention to provide an electrical connector in which one of a pair of matable connectors is angularly adjustable with respect to the other.

An electrical connector according to the present invention intended to achieve the above objects comprises a first housing and a second housing pivotally mounted in the first housing. The first housing includes a contact section and a tine or post section; the contact section is secured in the first housing which is positioned in a cavity in the second housing, and the post section extends outwardly from the first housing. Also, the second housing has a contact section secured in the cavity of the second housing and slidably engages the contact section of the first contact with a tine or post section extending outwardly from the second housing.

The post sections of the first and second contacts are generally soldered to through holes in the printed circuit boards.

In the electrical connector according to the present invention, the second housing having the second contact secured therein is allowed to pivotally move within a certain angle with respect to the first housing having the first contact secured therein while maintaining electrical connection between the first and second contacts.

An embodiment of the present invention will be described in detail by way of example hereunder with reference to the accompanying drawings.

Figure 1:
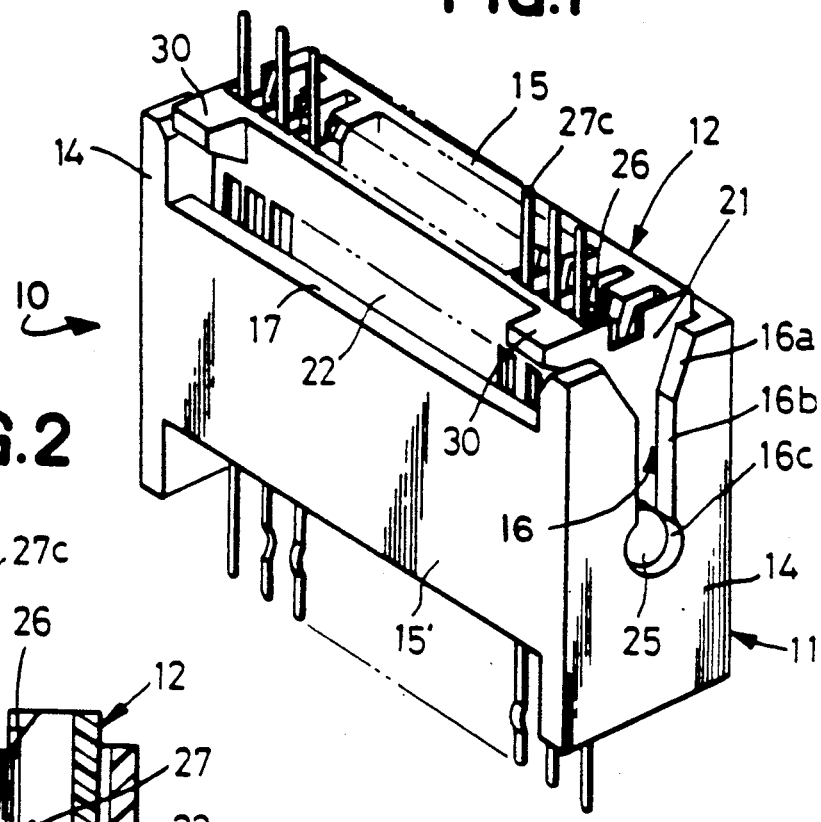
FIG. 1 is a perspective view of an embodiment of the connector according to this invention shown in the mated condition.
Figure 2:
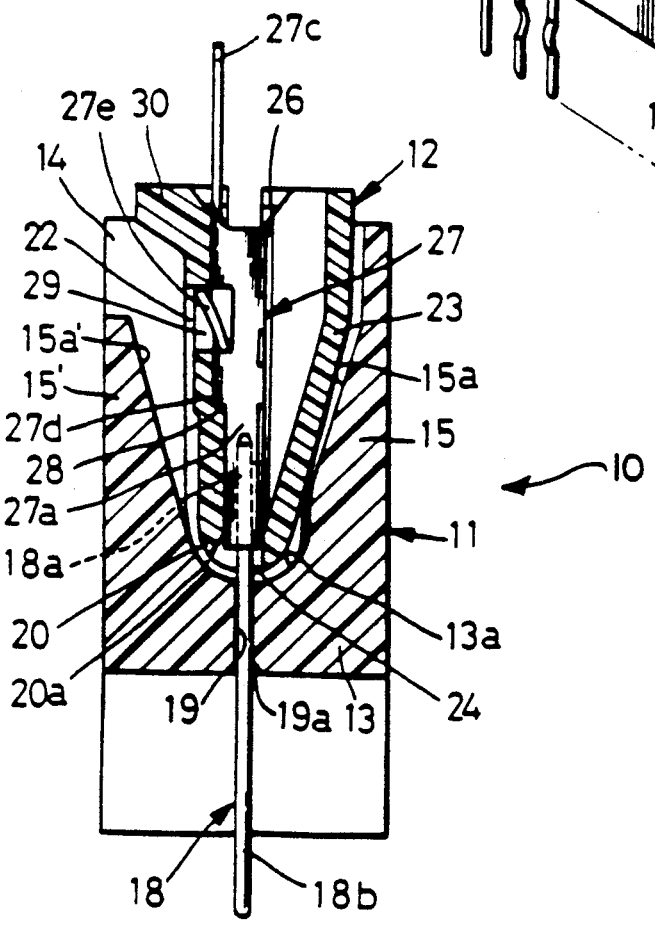
FIG. 2 is a vertical cross-sectional view of FIG. 1.
Figure 3:
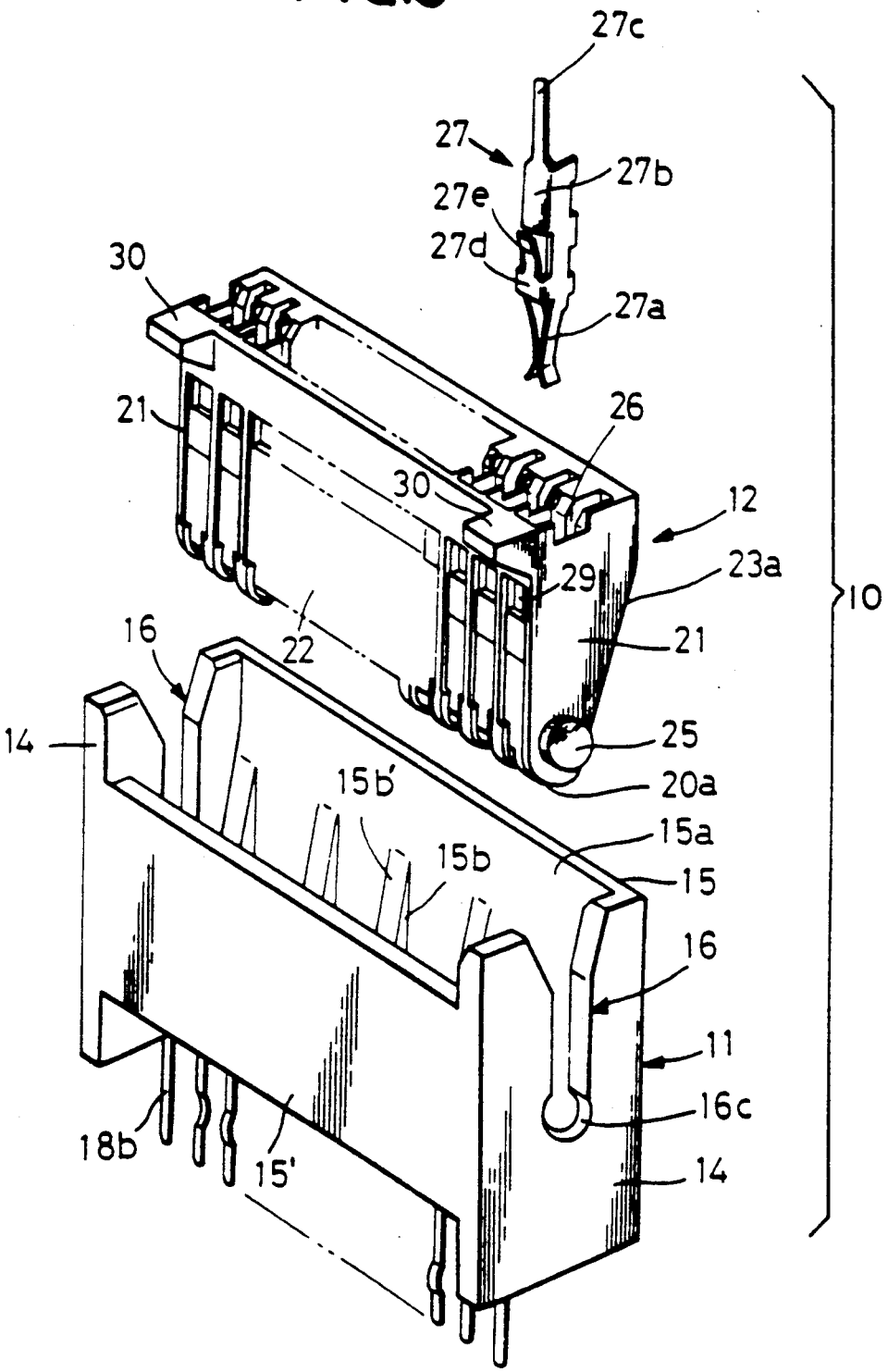
FIG. 3 is an exploded perspective view of the connector.

Referring to FIGS. 1 through 3, the connector 10 includes an outer housing 11 and an inner housing 12 to be mated in the outer housing 11. These housings 11, 12 are made from a suitable electrical insulation material, for example, plastic.

The outer housing 11 comprises end walls 14 extending vertically from a bottom wall 13 and sidewalls 15, 15' extending vertically from the bottom wall 13, walls 14, 15, 15' being orthogonal to each other. Slots 16 are formed in the walls 14, each of the slots 16 comprising tapered sections **16*a*, vertical sections 16*b*, and an arcuate bearing section 16*c***.

As shown in FIG. 2, the right and left sidewalls 15, 15' have tapered inner walls **15*a*, 15*a'* with wider spacing toward the top surface of the housing 11. However, edges 15*b* of triangle-shaped ribs 15*b* extend along the inner tapered surface 15*a* of the side wall 15 at a certain pitch (see FIG. 3.). Although not shown in the drawings, the inner surface 15*a'* of the sidewall 15' is formed similar to the sidewall 15, thereby providing opposite edges of triangle-shaped ribs on both sidewalls. A recess 17 is formed at the top of the sidewall 15'. The inner surface 13*a* of the bottom wall 13** is arcuate.

A plurality of tab contacts 18 are disposed in retaining holes 19 in the bottom wall 13 at a constant pitch along the length of the bottom wall 13. The tab contacts 18 are secured in the holes 19 not to move vertically. Tapered surfaces **19*a* are formed at the bottom ends of retaining holes 19 for convenience of insertion of the tab contacts 18 in the retaining holes 19. The tab contacts 18 are made of electrically-conductive metal and comprise contact sections 18*a* and tine or post sections 18*b*. The contact sections 18*a* extend between both sidewalls 15, 15' and the post sections 18*b* extend outwardly from the bottom wall 13**.

The inner housing 12 comprises, as best shown in FIGS. 2 and 3, end walls 21 and sidewalls 22, 23 extending vertically from a bottom wall 20. The sidewall 23 is constructed to adapt to the shape of the sidewall inner surface **15*a* of the outer housing 11. An outer bottom surface 20*a* is formed as an arcuate surface to enable pivotable movement along the inner bottom surface 13*a* of the outer housing 11. Through holes 24 for the tab contact sections 18*a* are formed in the bottom wall 20 at the constant pitch corresponding to the pitch of the tab contacts 18. The left side surface of the through holes 24 is sloped by a certain angle with respect to the right side surface as shown in FIG. 2. Circular shaft members 25 are formed adjacent the lower ends of the end walls 21 to be pivotally mounted on the bearing sections 16*c* of slots 16**.

In FIGS. 1 and 2, the inner housing 12 is capable of moving clockwise and counterclockwise about the shaft members 25. The inner housing 12 has a plurality of vertical cavities 26 disposed at a constant pitch along the length of the inner housing 12. Receptacle contacts 27 are loaded in the cavities 26 in such a manner to prevent their vertical movement. The receptacle contacts 27 are made of electrically-conductive metal and comprise a pair of resilient contact sections 27*a* extending downwardly, a U-shaped section 27*b* and a tine or post section 27*c*. The receptacle contacts 27 further comprise a shoulder section 27*d* at the lower end of the section 27*b*, and a lance section 27*e* curved outwardly. The shoulder sections 27*d* engage step portions 28 in an inner surface of the sidewall 22 while the lance sections 27*e* engage the upper end of openings 29 formed in the sidewall 22, thereby retaining the receptacle contacts 27 in position in the cavities 26.

The contact sections 18*a* of the contacts 18 are electrically connected between the resilient paris of contact sections 27*a* (see FIG. 2). Projections 30 are located at the upper ends of the sidewall 22 and they act as an operator's finger-engaging sections to remove the inner housing 12 from the outer housing 11 and also help to prevent incorrect mating of the two housings 11, 12.

Figure 4:
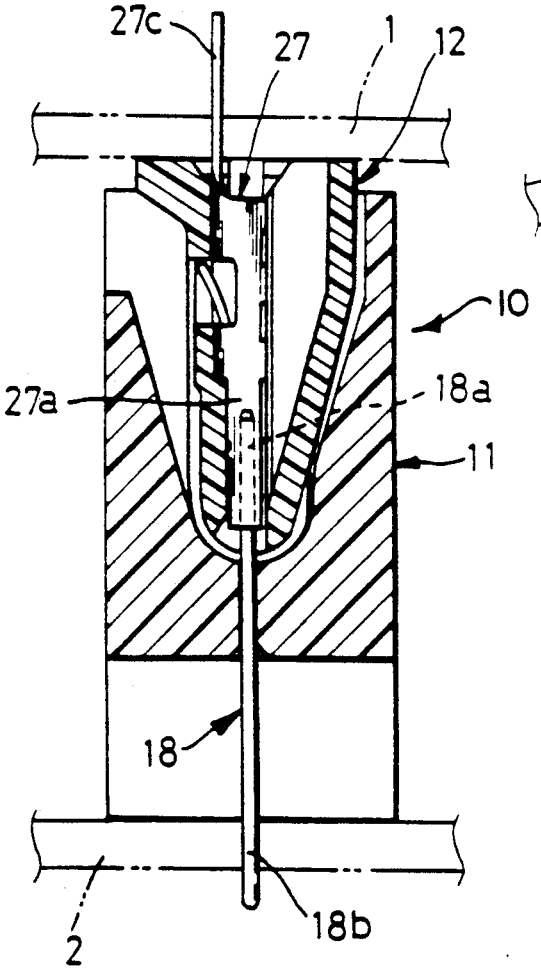
FIG. 4 is a cross-sectional view of the first housing.
Figure 5:
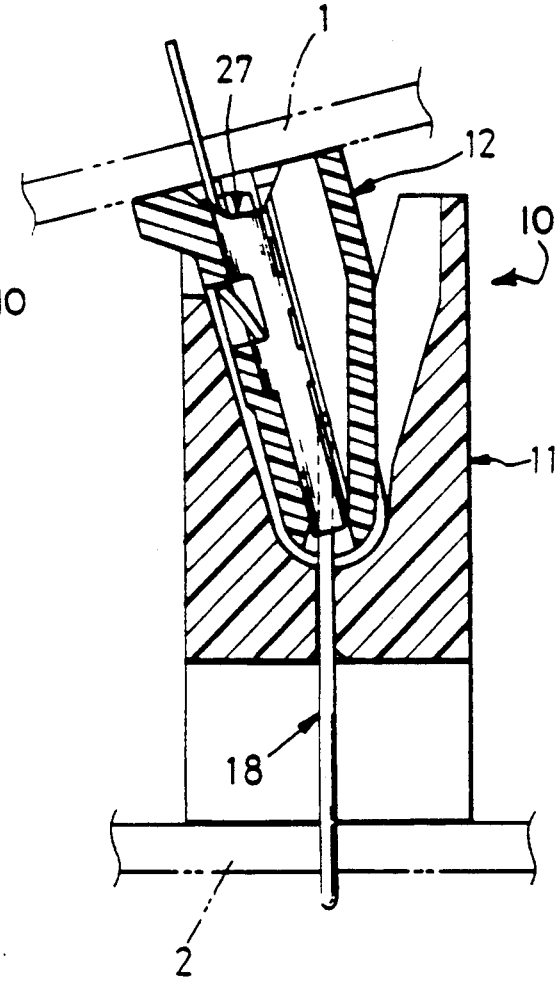
FIG. 5 is a cross-sectional view of the first housing in a slanted position from the vertical position relative to the second housing as shown in FIG. 4.
Figure 6:
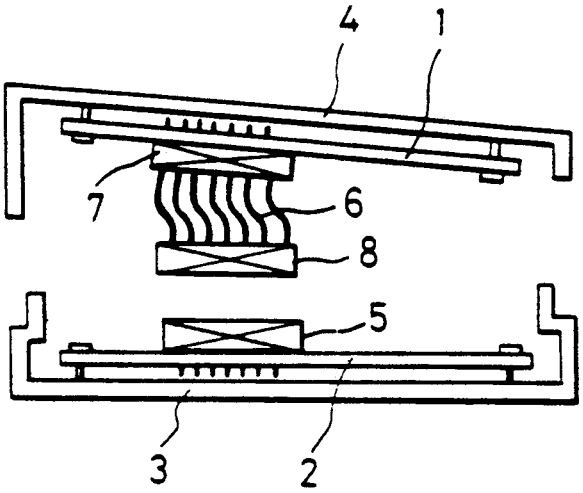
FIG. 6 is a simplified view to show a simplified construction of a conventional telephone set with the base housing separated from the cover housing.

As shown in FIGS. 4 and 5, the post sections 18*b*, 27*c* are electrically connected to the circuit boards 1, 2 discussed above by reference to FIG. 6. The inner housing 12 is rotated counterclockwise by a given angle in response to the sloped position from the horizontal position of the printed circuit board 1. When the inner housing 12 is in its vertical position, center lines of the contacts 18, 27 coincide with each other; however, in the sloped or slanted position from the vertical position, the inner housing 12 moves via the shaft members 25 while always maintaining desired electrical connection between the contact sections 18*a*, 27*c* of the contacts 18, 27.

The present invention is not limited to an electrical connector for telephones comprising matable base and cover housings, but it is suitable as an electrical connector for applications whereby circuit boards are angularly positioned relative to one another.

The electrical connector of the present invention is applicable to electrical connections between printed circuit boards mounted on matable base and cover housings of, for example, a telephone. A first housing retaining first contacts of a first connector is disposed on the printed circuit board of the base housing and electrically connected thereto while a second housing retaining second contacts of a second connector is disposed on the printed circuit board of the cover housing and electrically connected thereto. The first and second connectors are electrically interconnected to provide the following advantages.

Even if the printed circuit board of the cover housing is sloped at a certain angle with respect to the printed circuit board of the base housing, the second connector is pivotally movable with respect to the first connector, thereby enabling the cover housing to be mated with the base housing while the second connector is positioned at a desired angle and the first connector is oriented vertically. Simultaneously, the first and second connectors can be electrically connected.

As described above, the adjustable design of the second connector with respect to the first connector in accordance with the sloped orientation of the printed circuit board of the cover housing makes it applicable to various telephone sets.

Although the above description is, for example, directed to telephone applications, it is to be understood that the electrical connector of the present invention is also applicable to other electrical devices similar to telephone sets in construction.

What is claimed is:

1. An electrical connector of the type adapted to interconnect a first circuit board in an overlying and slightly angled relationship to a second circuit board including a first housing having a cavity defined by sidewalls with interior portions having sloped surfaces leading to a rounded bottom portion and end walls each having a guide slot open from the top of the housing defined by tapered guide surfaces leading to a bearing surface, a row of tab contacts mounted in said first housing cavity with portions extending interiorly of said cavity and portions extending through said bottom wall to be connected to the first circuit board, a second housing having exterior side walls of a geometry to fit substantially entirely down within the cavity of the first housing and allow a slight rotary movement therewithin and end walls each including a bearing shaft positioned to engage the tapered guide surface of the guide slot upon entry of the second housing into said cavity to guide the second housing into a position with the shafts resting in the bearing surfaces to facilitate said slight rotary movement of the second housing within the first housing, the second housing having a row of receptacle contacts each having a tab portion connected to the second circuit board and receptacle portions to receive the interiorly disposed contacts of the first housing inserted therein to facilitate slight rotary movement between said contacts and said housings and provide interconnection of the first and second circuit boards on the slightly angled overlying relationship.

2. The connector of claim 1 wherein the interior portions of the said first housing are formed by ribs extending interiorly of said cavity.

3. The connector of claim 1 wherein the second housing includes interior cavities with the receptacle contacts contained therewithin to receive the interiorly disposed portions of the contacts of the first housing inserted within said receptacle contacts.

4. An assembly of electrical components including a base and a cover adapted to be mated together, the said base and cover having planar surfaces with printed circuit boards mounted thereon and edge surfaces dimensioned to hold the planar surfaces and printed circuit boards at a slight angle, a connector for the components including a first housing having tab contacts connected to the printed circuit board of the base and a second housing having receptacle contacts connected to the printed circuit board of the cover, the first housing having a cavity defined by side walls including interior tapered portions and end walls each having a slot with a tapered surface extending from the top of the housing toward the bottom of the housing and leading to a bearing surface, the tab contacts of the first housing extending in a row within the said cavity, a second housing having an exterior geometry to fit substantially entirely within the cavity of the first housing and allow limited rotary movement of the second housing therewithin, said second housing including shafts projecting from the ends positioned to fit within the first housing ed wall slots and guide insertion of the second housing within the first housing cavity, the receptacle contacts being contained within the second housing in a position to receive the tab contacts inserted therewithin and having surfaces to facilitate rotary movement of the tab contacts within the receptacle contacts to thus facilitate the limited rotary movement of said second housing within said first housing and said printed circuit boards, base and cover relative to each other.

5. The assembly of claim 4 wherein the components are parts of a telephone having a horizontal base and a sloped cover with the printed circuit boards fixed thereto and the contacts soldered to such boards prior to assembly of cover to base.

* * * * *